US009202414B2

(12) United States Patent
Hu et al.

(10) Patent No.: US 9,202,414 B2
(45) Date of Patent: Dec. 1, 2015

(54) ORGANIC LIGHT-EMITTING DIODE PIXEL CIRCUIT, DISPLAY PANEL AND DISPLAY DEVICE

(71) Applicants: Shanghai Tianma AM-OLED Co., Ltd, Shanghai (CN); TIANMA MICRO-ELECTRONICS CO., LTD., Shenzhen (CN)

(72) Inventors: Xiaoxu Hu, Shanghai (CN); Li Zhang, Shanghai (CN); Wei He, Shanghai (CN)

(73) Assignees: SHANGHAI TIANMA AM-OLED CO., LTD, Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 0 days.

(21) Appl. No.: 14/271,421

(22) Filed: May 6, 2014

(65) Prior Publication Data

US 2015/0187269 A1 Jul. 2, 2015

(30) Foreign Application Priority Data

Dec. 30, 2013 (CN) ..... 2013 1 0747054

(51) Int. Cl.
*G09G 3/32* (2006.01)

(52) U.S. Cl.
CPC ..... *G09G 3/3258* (2013.01); *G09G 3/3291* (2013.01); *G09G 2300/0819* (2013.01); *G09G 2300/0842* (2013.01); *G09G 2320/0233* (2013.01)

(58) Field of Classification Search
CPC ..... G09G 3/3258; G09G 3/3291; G09G 2300/0819; G09G 2300/0842; G09G 2320/0233
USPC ..... 345/76, 204; 315/51, 169.3
See application file for complete search history.

(56) References Cited

U.S. PATENT DOCUMENTS

| | | | | |
|---|---|---|---|---|
| 7,205,965 | B2 * | 4/2007 | Mikami | G09G 3/3233 345/76 |
| 7,218,295 | B2 * | 5/2007 | Sung | G09G 3/3233 315/169.1 |
| 7,636,073 | B2 * | 12/2009 | Ono | G09G 3/3241 315/169.3 |
| 8,111,217 | B2 * | 2/2012 | Caligiore | G09G 3/3233 315/169.3 |
| 8,154,483 | B2 * | 4/2012 | Takasugi | G09G 3/3233 315/169.3 |
| 2004/0227706 | A1 * | 11/2004 | Sung | G09G 3/3233 345/76 |
| 2004/0246209 | A1 * | 12/2004 | Sung | G09G 3/3233 345/76 |
| 2006/0066252 | A1 * | 3/2006 | Kim | G09G 3/3233 315/169.3 |
| 2006/0244695 | A1 * | 11/2006 | Komiya | F09F 3/006 345/76 |

FOREIGN PATENT DOCUMENTS

CN 103035201 A 4/2013

* cited by examiner

*Primary Examiner* — Amare Mengistu
*Assistant Examiner* — Stacy Khoo
(74) *Attorney, Agent, or Firm* — Kilpatrick Townsend & Stockton LLP

(57) ABSTRACT

An organic light-emitting diode pixel circuit is disclosed. The circuit includes a signal loading module, an organic light-emitting diode, a drive transistor connected to the signal loading module and configured to provide a current to the organic light-emitting diode. The circuit also includes a storage capacitor connected to the drive transistor, and first and second switch modules configured to selectively control current to and from the drive transistor. In addition, a display panel including the organic light-emitting diode pixel circuit and a display device comprising the display panel are also disclosed.

19 Claims, 10 Drawing Sheets

*--Prior Art--*

ORGANIC LIGHT-EMITTING DIODE PIXEL CIRCUIT, DISPLAY PANEL AND DISPLAY DEVICE

CROSS-REFERENCES TO RELATED APPLICATIONS

This application claims priority to Chinese patent application No. 201310747054.X filed on Dec. 30, 2013, the content of which is incorporated herein by reference in its entirety.

TECHNICAL FIELD

The present invention relates to the field of organic light-emitting display technologies and particularly to an organic light-emitting diode pixel circuit, a display panel and a display device.

BACKGROUND OF THE INVENTION

An Active Matrix Organic Light Emitting Diode (AMOLED) display has been widely applied due to its wide angle of view, good color contrast effect, high response speed, self-illuminating and other advantages.

An AMOLED typically adopts low-temperature polysilicon as a drive layer to implement its pixel drive circuit. As compared with a general amorphous-silicon process, the low-temperature polysilicon thin film transistor characterized by its higher mobility and more stability is more suitable for the AMOLED display.

At present, a pixel circuit illustrated in FIG. 1 is typically adopted in a large-size display panel, where drive currents of all the pixels is provided by the same power source VDD. A power line on a backboard for directing the power source VDD to pixels in respective rows has a certain resistance, and the respective rows of pixels are lighted constantly, so current flows over the power line all the time, and consequently the voltage on the power line varies at the different rows of pixels. For example, if the voltage on the power line is VDD−1 at the first row of pixels and VDD−n at the n-th row of pixels, then VDD−1 is larger than VDD−n by an amount dependent on the current on the power line and the resistance of the power line. Moreover, a picture displayed by the display panel is changing constantly, so the current flowing through the power line is also changing constantly, so that the voltage at the n-th row of pixels may be indeterminate, that is, with the same data signal received at the n-th row of pixels at different moments, the current flowing through the power line is changing, so that the voltage difference between the gate of a drive transistor M3 and the source of the drive transistor M3 is also changing and consequently the current driving a diode OLED to emit light is changing, thus resulting in a poor display effect.

In FIG. 1, the pixel circuit further includes a P-type transistor M1, a P-type transistor M2, a P-type transistor M3, a P-type transistor M4, a P-type transistor M5, a P-type transistor M6, a capacitor C1, a capacitor C2, and an OLED, where the gate of the P-type transistor M1 and the gate of the P-type transistor M6 receive an emitted signal EMIT, the gate of the P-type transistor M5 receives a first scan signal SCANT, the gate of the P-type transistor M2 and the gate of the P-type transistor M3 receive a second scan signal SCAN2, and the source of the P-type transistor M5 receives a reference signal Vref.

BRIEF SUMMARY OF THE INVENTION

In summary, in the existing OLED pixel circuit, there is current flowing all the time over the power line directing the power source VDD to the respective rows of pixels and there is also a resistance on the power line, so that the voltage on the power line varies at the different rows of pixels, and consequently there may be a display brightness varying with the different pixels at which the same data signal is received, thus resulting in display non-uniformity of the display panel.

One inventive aspect is an organic light-emitting diode pixel circuit. The circuit includes a signal loading module, an organic light-emitting diode, a drive transistor connected to the signal loading module and configured to provide a current to the organic light-emitting diode. The circuit also includes a storage capacitor connected to the drive transistor, and first and second switch modules configured to selectively control current to and from the drive transistor. A first terminal of the signal loading module is connected with a data signal for a current image frame, a second terminal of the signal loading module is connected with a first scan signal, and a third terminal of the signal loading module is connected with a gate of the drive transistor and a first terminal of the storage capacitor. In addition, a fourth terminal of the signal loading module is connected with a second scan signal, a fifth terminal of the signal loading module is connected with a first voltage signal, and a sixth terminal of the signal loading module is connected with a second terminal of the storage capacitor, a cathode of the organic light-emitting diode, and a first terminal of the first switch module. Furthermore, an anode of the organic light-emitting diode is configured to receive a high-level signal, a second terminal of the first switch module is connected with a source of the drive transistor, a first terminal of the second switch module is connected with a drain of the drive transistor, and a second terminal of the second switch module is connected with a low-level signal. In addition, the voltage of the first voltage signal is higher than the voltage of the high-level signal.

Another inventive aspect is a display panel. The display panel includes an organic light-emitting diode pixel circuit. The circuit includes a signal loading module, an organic light-emitting diode, a drive transistor connected to the signal loading module and configured to provide a current to the organic light-emitting diode. The circuit also includes a storage capacitor connected to the drive transistor, and first and second switch modules configured to selectively control current to and from the drive transistor. A first terminal of the signal loading module is connected with a data signal for a current image frame, a second terminal of the signal loading module is connected with a first scan signal, and a third terminal of the signal loading module is connected with a gate of the drive transistor and a first terminal of the storage capacitor. In addition, a fourth terminal of the signal loading module is connected with a second scan signal, a fifth terminal of the signal loading module is connected with a first voltage signal, and a sixth terminal of the signal loading module is connected with a second terminal of the storage capacitor, a cathode of the organic light-emitting diode, and a first terminal of the first switch module. Furthermore, an anode of the organic light-emitting diode is configured to receive a high-level signal, a second terminal of the first switch module is connected with a source of the drive transistor, a first terminal of the second switch module is connected with a drain of the drive transistor, and a second terminal of the second switch module is connected with a low-level signal. In addition, the voltage of the first voltage signal is higher than the voltage of the high-level signal.

DETAILED DESCRIPTION OF THE PREFERRED EMBODIMENTS

With an OLED pixel circuit, a display panel and a display device according to embodiments of the invention, in a data signal loading phase, a data signal of current image frame is transmitted to a first terminal of a storage capacitor through a third terminal of a signal loading module and a first voltage signal is transmitted to a second terminal of the storage capacitor through a sixth terminal of the signal loading module; and in a display phase, the data signal of the current image frame is not transmitted to the first terminal of the storage capacitor any longer and the first voltage signal is not transmitted to the second terminal of the storage capacitor any longer; and in the display phase, the OLED is driven by the signal stored in the storage capacitor to emit light, where drain current driving the OLED to emit light is independent of a high-level signal, thereby avoiding the situation that there is current flowing all the time over a power line directing a power source VDD to respective rows of pixels and there is also a resistance on the power line so that the voltage on the power line varies at the different rows of pixels, and hence addressing the problem of varying current driving the different pixels at which the same data signal is received, so as to improve the display uniformity.

Particular embodiments of an OLED pixel circuit, a display panel and a display device according to embodiments of the invention will be described below with reference to the drawings.

Figure 1:
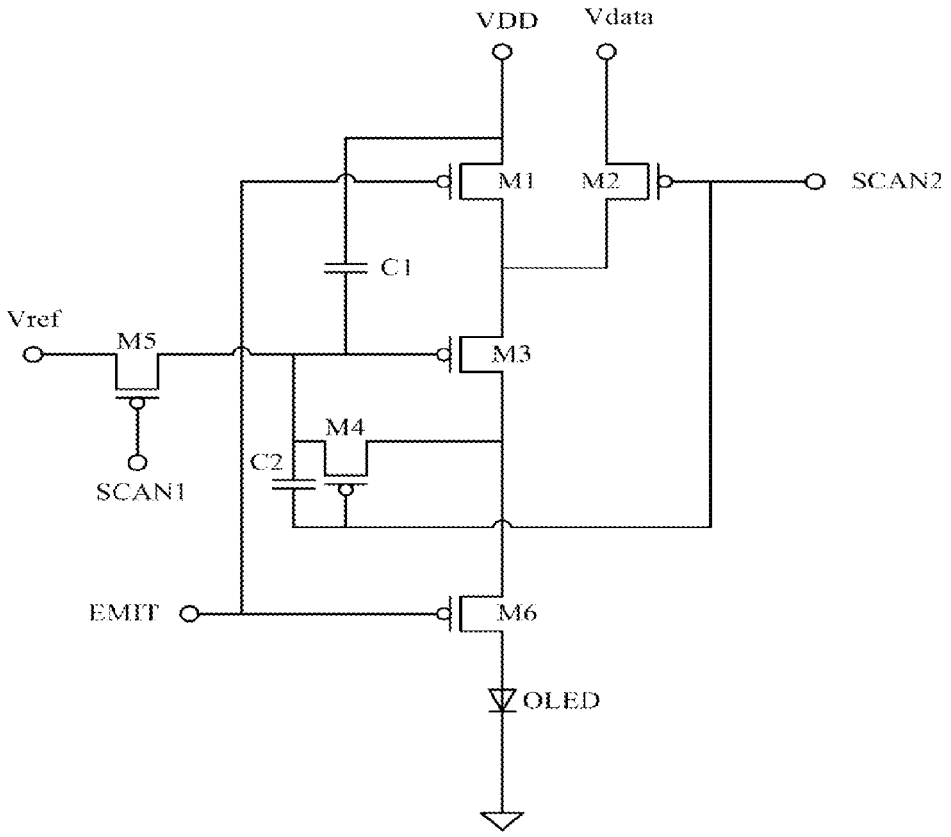
FIG. 1 is a circuit diagram of an OLED pixel circuit in the prior art.
Figure 2:
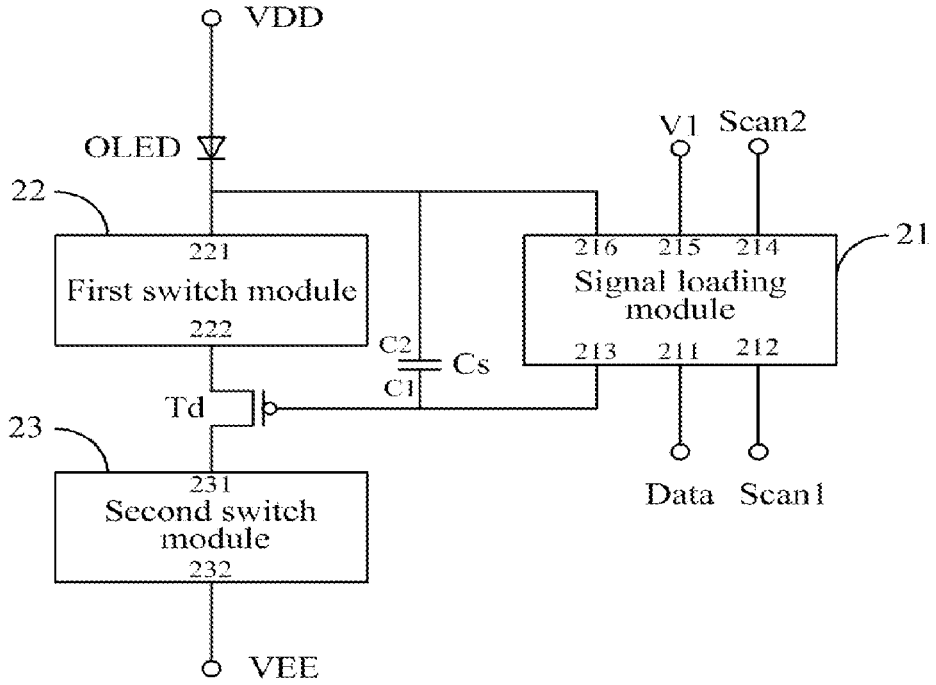
FIG. 2 is a schematic diagram of an OLED pixel circuit according to a first embodiment of the invention.

A first embodiment of the invention provides an OLED pixel circuit, as illustrated in FIG. 2, which includes a signal loading module 21, an Organic Light-Emitting Diode (OLED), a drive transistor Td, a storage capacitor Cs, a first switch module 22 and a second switch module 23.

A first terminal 211 of the signal loading module 21 is connected with a data signal Data of a current image frame, a second terminal 212 of the signal loading module 21 receives a first scan signal Scan1, a third terminal 213 of the signal loading module 21 is connected respectively with a gate of the drive transistor Td and a first terminal C1 of the storage capacitor Cs, a fourth terminal 214 of the signal loading module 21 receives a second scan signal Scan2, a fifth terminal 215 of the signal loading module 21 receives a first voltage signal V1, and a sixth terminal 216 of the signal loading module 21 is connected respectively with a second terminal C2 of the storage capacitor Cs, a cathode of the Organic Light-Emitting Diode (OLED) and a first terminal 221 of the first switch module 22.

An anode of the Organic Light-Emitting Diode (OLED) receives a high-level signal VDD, a second terminal 222 of the first switch module 22 is connected with a source of the drive transistor Td, a first terminal 231 of the second switch module 23 is connected with a drain of the drive transistor Td, and a second terminal 232 of the second switch module 23 receives a low-level signal VEE.

The voltage of the first voltage signal V1 is higher than the voltage of the high-level signal VDD.

An operation period of the OLED pixel circuit according to the first embodiment includes two periods of time, which are a data signal loading phase and a display phase.

In the data signal loading phase, the signal loading module 21 transmits the data signal Data of the current image frame to the first terminal C1 of the storage capacitor Cs through the third terminal 213 of the signal loading module 21, and transmits the first voltage signal V1 to the second terminal C2 of the storage capacitor Cs through the sixth terminal 216 of the signal loading module 21. In the display phase, the signal loading module 21 does not transmit the data signal Data of the current image frame to the first terminal C1 of the storage capacitor Cs any longer, and does not transmit the first voltage signal V1 to the second terminal C2 of the storage capacitor Cs any longer.

The first switch module 22 and the second switch module 23 are turned off in the data signal loading phase and turned on in the display phase.

The drive transistor Td drives the Organic Light-Emitting Diode (OLED) to emit light by the signal stored in the storage capacitor Cs after the first switch module 22 and the second switch module 23 are turned on.

Figure 3:
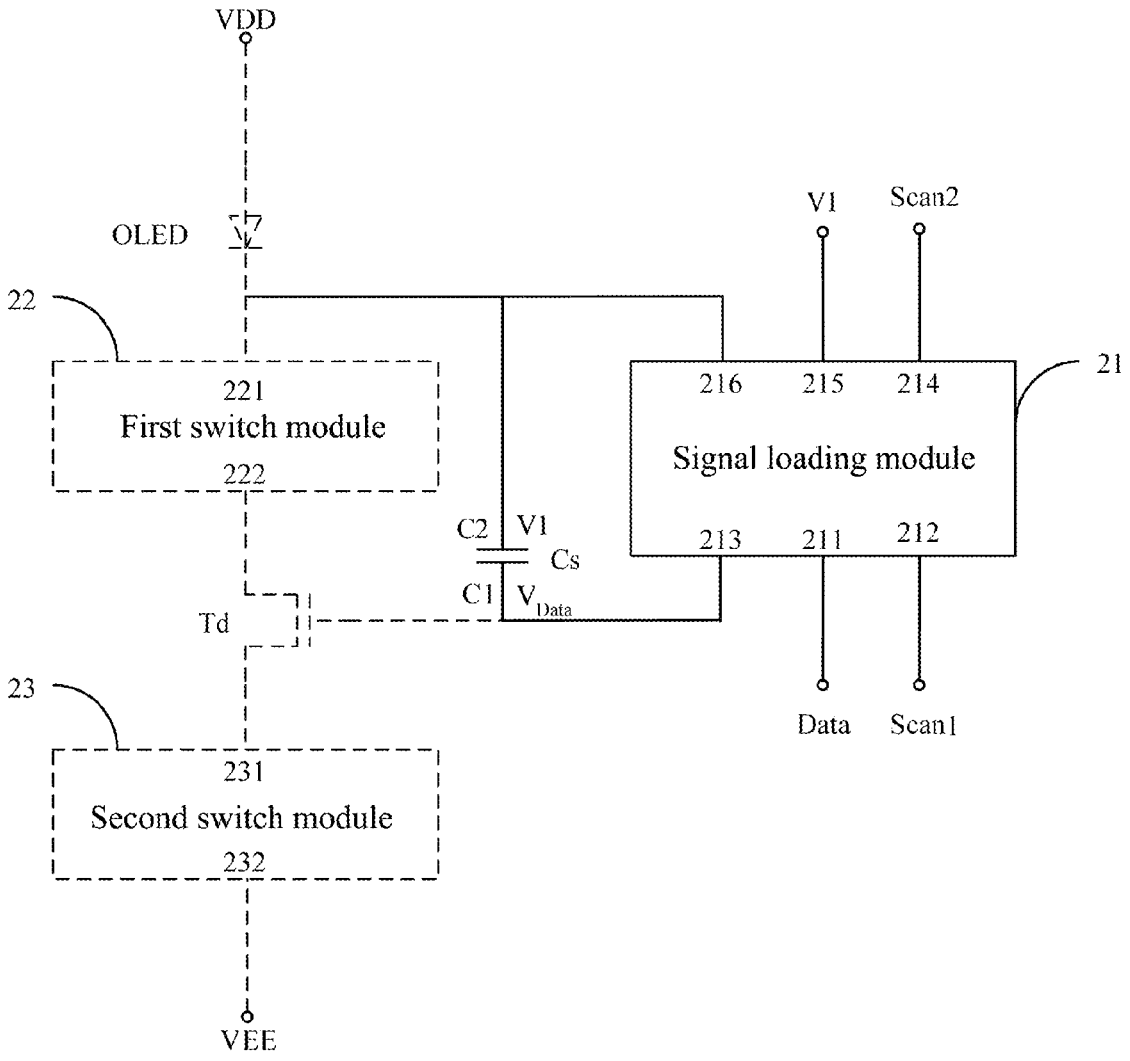
FIG. 3 is a schematic diagram of the OLED pixel circuit according to the first embodiment of the invention operating in a data signal loading phase.
Figure 4:
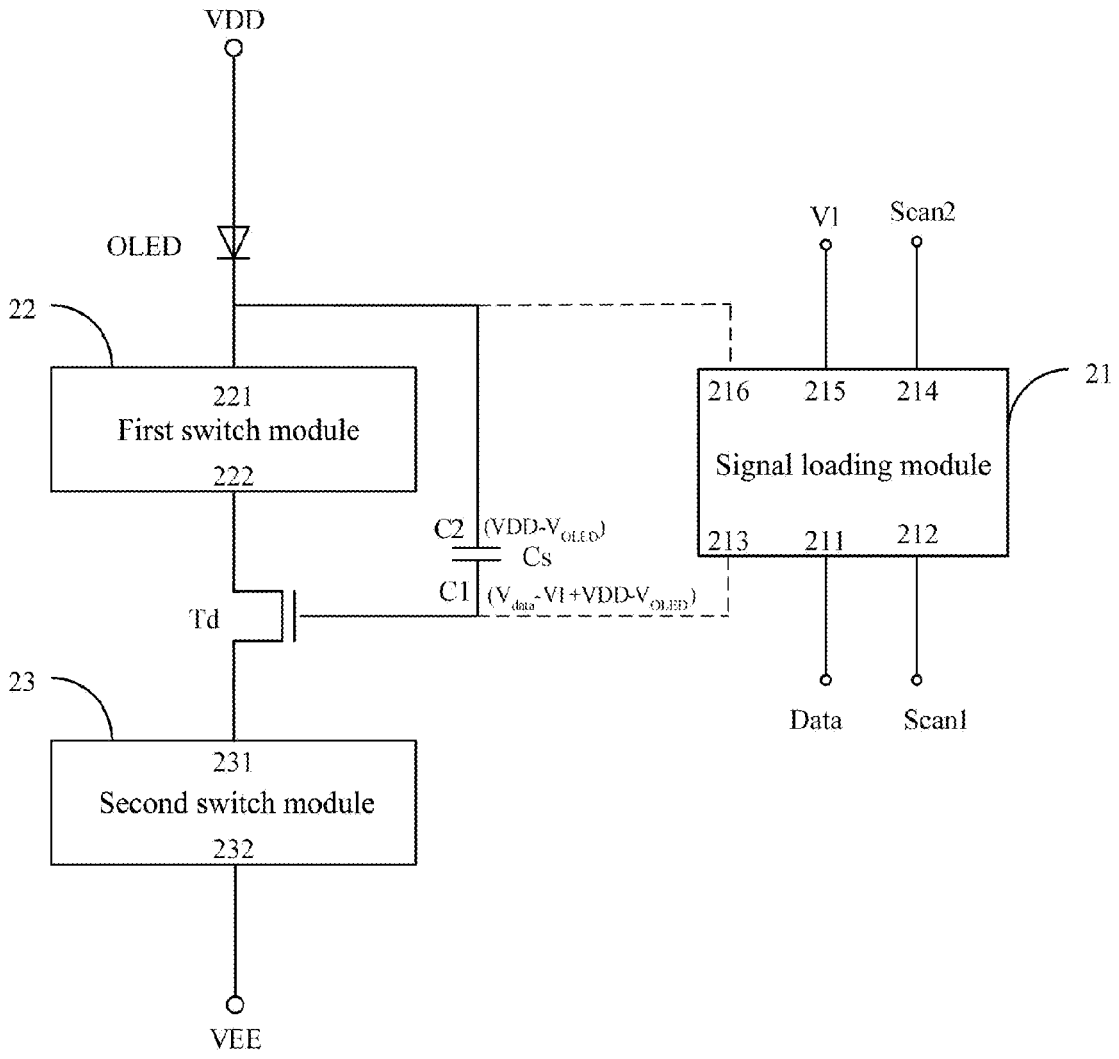
FIG. 4 is a schematic diagram of the OLED pixel circuit according to the first embodiment of the invention operating in a display phase.

Referring to FIG. 3 and FIG. 4, FIG. 3 is a schematic diagram of the OLED pixel circuit operating in the data signal loading phase, and FIG. 4 is a schematic diagram of the OLED pixel circuit operating in the display phase.

Referring to FIG. 3, in the data signal loading phase, the first switch module 22 and the second switch module 23 are turned off. Moreover, in the data signal loading phase, the signal loading module 21 transmits the data signal Data of the current image frame to the first terminal C1 of the storage capacitor Cs through the third terminal 213 of the signal loading module 21, and transmits the first voltage signal V1 to the second terminal C2 of the storage capacitor Cs through the sixth terminal 216 of the signal loading module 21. Thus, at the end of the data signal loading phase, the voltage at the first terminal C1 of the storage capacitor Cs is $V_{Data}$ and the voltage at the second terminal C2 of the storage capacitor Cs is V1. Since the voltage of the first voltage signal V1 is higher than the voltage of the high-level signal VDD, the Organic Light-Emitting Diode (OLED) is turned off in the data signal loading phase. Referring to FIG. 4, in the display phase, the signal loading module 21 does not transmit the data signal Data of the current image frame to the first terminal C1 of the storage capacitor Cs through the third terminal 213 of the signal loading module 21 any longer, and does not transmit the first voltage signal V1 to the second terminal C2 of the storage capacitor Cs through the sixth terminal 216 of the signal loading module 21 any longer, and the first switch module 22 and the second switch module 23 are turned on. At the beginning of the display phase, the voltage at the second terminal C2 of the storage capacitor Cs is V1, and the voltage of the first voltage signal V1 is higher than the voltage of the high-level signal VDD, that is, the voltage at the cathode of the Organic Light-Emitting Diode (OLED) is higher than the voltage at the anode thereof, so the Organic Light-Emitting Diode (OLED) still is turned off even if the first switch module 22 and the second switch module 23 have been turned on at that time.

Referring to FIG. 4, at the beginning of the display phase, the voltage at the first terminal C1 of the storage capacitor Cs is $V_{Data}$, and the drive transistor Td is controlled by the voltage $V_{Data}$ to be turned on, and also the first switch module 22 and the second switch module 23 are turned on, so a pathway is formed from the first terminal 221 of the first switch module to the input terminal of the low-level signal VEE, and the voltage V1 at the second terminal C2 of the storage capacitor Cs is higher than the voltage of the low-level signal VEE, then current is generated in the pathway.

When the current flows through the pathway, the potential at the second terminal C2 of the storage capacitor Cs decreases constantly, and when the voltage at the second terminal C2 of the storage capacitor Cs decreases to be lower than the voltage of the high-level signal VDD, that is, the potential at the cathode of the Organic Light-Emitting Diode (OLED) is lower than the potential at the anode thereof, the Organic Light-Emitting Diode (OLED) is turned on, and when the current flowing through the Organic Light-Emitting Diode (OLED) is stable, there is a fixed voltage difference $V_{OLED}$ between the anode and the cathode thereof, that is, the voltage difference between the anode and the second terminal C2 of the storage capacitor Cs. The value of the fixed voltage difference $V_{OLED}$ is determined by the device size, the resistance, etc., of the Organic Light-Emitting Diode (OLED).

At this time, the voltage $V_{c2}$ at the second terminal C2 of the storage capacitor Cs is $VDD-V_{OLED}$, that is, compared with the beginning, the voltage at the second terminal C2 of the storage capacitor Cs decreases by ΔV:

$$\Delta V=V1-(VDD-V_{OLED}).$$

Since the first terminal C1 of the storage capacitor Cs floats, the voltage at the first terminal C1 of the storage capacitor Cs may also decrease by ΔV, then at this time the voltage at the first terminal C1 of the storage capacitor Cs is:

$$V_{C1}=V_{Data}-\Delta V=V_{Data}-V1+VDD-V_{OLED}.$$

Thus, at this time, the gate-source voltage difference Vgs of the drive transistor Td is:

$$Vgs=V_{C2}-V_{C1}=(VDD-V_{OLED})(V_{Data}-V1+VDD-V_{OLED})=V1-V_{Data}.$$

As can be apparent from the formula in which Vgs is calculated, with the OLED pixel circuit according to the first embodiment of the invention, there is no relationship between the value of the gate-source voltage difference Vgs of the drive transistor Td and the high-level signal VDD, that is, an influence of the high-level signal VDD on the gate-source voltage difference Vgs of the drive transistor Td can be eliminated.

The value of the stabilized current $I_{OLED}$ flowing through the Organic Light-Emitting Diode (OLED) may be calculated according to the formula reflecting a current characteristic of a transistor operating in a saturation area as:

$$I_{OLED}=K(Vgs-|Vth|)^2.$$

Where K is a structural parameter, and Vth is the threshold voltage of the transistor, and the values of K and Vth are ascertained values for a certain transistor; and Vgs is the gate-source voltage difference of the drive transistor Td, and Vgs is equal to $V1-V_{Data}$ for the OLED pixel circuit according to the first embodiment of the invention, and then the current $I_{OLED}$ flowing through the Organic Light-Emitting Diode (OLED) is: $I_{OLED}=K(V1-V_{Data}-|Vth|)^2$.

As can be apparent, the current $I_{OLED}$ flowing through the Organic Light-Emitting Diode (OLED) is independent of the high-level signal VDD, to avoid the situation in the existing OLED pixel circuit that there is current flowing all the time over a power line directing a backboard power source VDD to respective rows of pixels and there is a resistance on the power line so that the voltage on the power line varies at the different rows of pixels, and hence address the problem of varying current driving the different pixels at which the same data signal is received, so as to improve the display uniformity.

Although the current $I_{OLED}$ driving the Organic Light-Emitting Diode (OLED) is related to the first voltage signal V1, current flows over a transmission line transmitting the first voltage signal V1 only when the storage capacitor is charged, and no current flows therethrough at other moments, that is, current flows therethrough only at the beginning of the data signal loading phase, and no current flows over the transmission line transmitting the first voltage signal V1 at the end of the data signal loading phase, so there is no voltage drop over the transmission line of the first voltage signal V1, and the voltage on the transmission line of the first voltage signal V1 is the same at the respective rows of pixels, that is, the drain current driving the Organic Light-Emitting Diode (OLED) is related to the first voltage signal V1, but this does not degrade the display uniformity.

Figure 5:
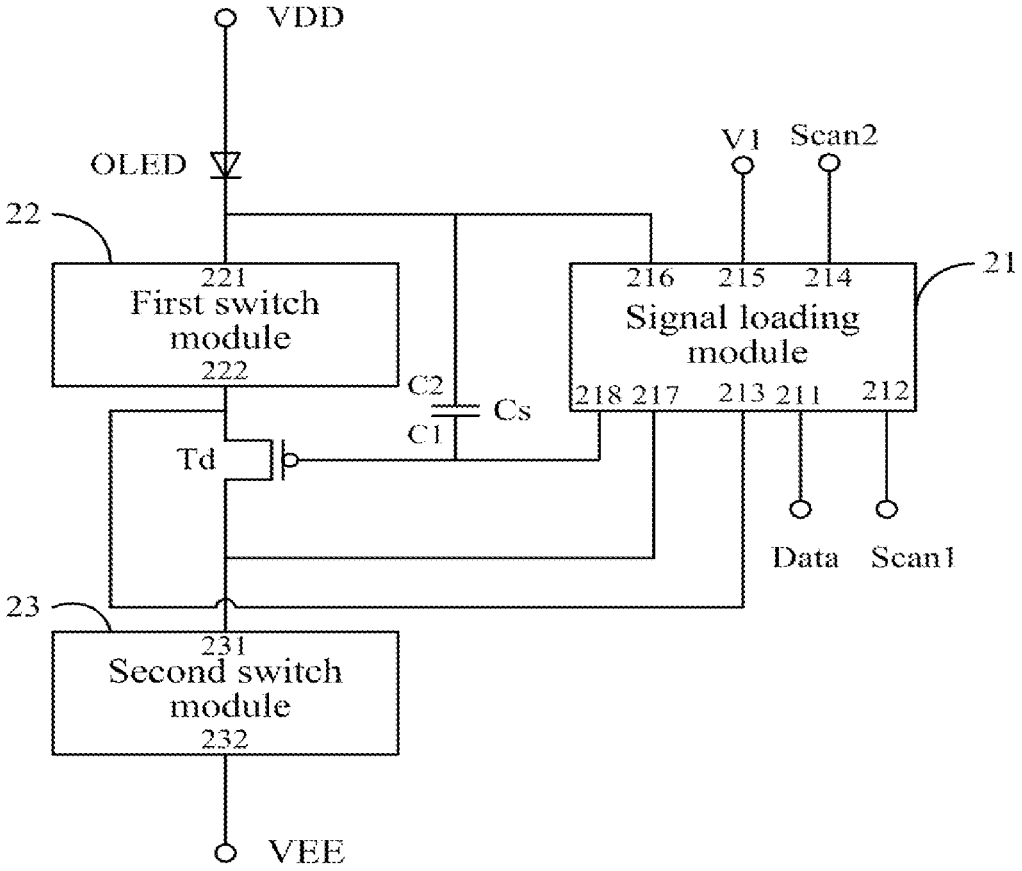
FIG. 5 is a schematic diagram of an OLED pixel circuit according to a second embodiment of the invention.

A second embodiment of the invention provides an OLED pixel circuit, as illustrated in FIG. 5, which includes a signal loading module 21, an Organic Light-Emitting Diode (OLED), a drive transistor Td, a storage capacitor Cs, a first switch module 22 and a second switch module 23.

A first terminal 211 of the signal loading module 21 receives a data signal Data of a current image frame, a second terminal 212 of the signal loading module 21 receives a first scan signal Scan1, a third terminal 213 of the signal loading module 21 is connected respectively with a gate of the drive transistor Td and a first terminal C1 of the storage capacitor Cs through a source of the drive transistor Td, a fourth terminal 214 of the signal loading module 21 receives a second scan signal Scan2, a fifth terminal 215 of the signal loading module 21 receives a first voltage signal V1, a sixth terminal 216 of the signal loading module 21 is connected respectively with a second terminal C2 of the storage capacitor Cs, a cathode of the Organic Light-Emitting Diode (OLED) and a first terminal 221 of the first switch module 22, a seventh terminal 217 of the signal loading module 21 is connected with a drain of the drive transistor Td, and an eighth terminal 218 of the signal loading module 21 is connected with the gate of the drive transistor Td, where the voltage of the first voltage signal V1 is higher than the voltage of a high-level signal VDD.

An anode of the OLED receives the high-level signal VDD, a second terminal 222 of the first switch module 22 is connected with the source of the drive transistor Td, a first terminal 231 of the second switch module 23 is connected with the drain of the drive transistor Td, and a second terminal 232 of the second switch module 23 receives a low-level signal VEE.

An operation period of the OLED pixel circuit according to the second embodiment includes two periods of time, which are a data signal loading phase and a display phase.

In the data signal loading phase, the signal loading module 21 has the gate of the drive transistor Td connected with the drain of the drive transistor Td, and transmits the data signal Data of the current image frame to the source of the drive transistor Td through the third terminal 213 of the signal loading module 21, and transmits the first voltage signal V1 to the second terminal C2 of the storage capacitor Cs through the sixth terminal 216 of the signal loading module 21. The voltage at the second terminal C2 of the storage capacitor Cs is V1 at the end of the data signal loading phase.

Since the gate of the drive transistor Td is connected with the drain of the drive transistor Td in the data signal loading phase, the voltage at the gate of the drive transistor Td is $V_{Data}-|Vth|$ at the end of the data signal loading phase, that is, the potential at the first terminal C1 of the storage capacitor Cs, where Vth is the threshold voltage of the drive transistor Td. Specifically, since the data signal Data of the current image frame is transmitted to the gate of the drive transistor Td through the source of the drive transistor Td, that is, charges the gate constantly, the drive transistor Td is turned off and the voltage at the gate $V_{Data}-|Vth|$ is fixed at the gate of the drive transistor Td when the potential difference between the gate and the source thereof is threshold voltage Vth.

Since the voltage of the first voltage signal V1 is higher than the voltage of the high-level signal VDD, the Organic Light-Emitting Diode (OLED) is turned off in the data signal loading phase.

In the display phase, the signal loading module 21 does not transmit the data signal Data of the current image frame to the first terminal C1 of the storage capacitor Cs through the third terminal 213 of the signal loading module 21 any longer, and does not transmit the first voltage signal V1 to the second terminal C2 of the storage capacitor Cs through the sixth terminal 216 of the signal loading module 21 any longer, and the first switch module 22 and the second switch module 23 are turned on.

At the beginning of the display phase, the voltage at the second terminal C2 of the storage capacitor Cs is still V1, and since the voltage of the first voltage signal V1 is higher than the voltage of the high-level signal VDD, that is, the voltage at the cathode of the Organic Light-Emitting Diode (OLED) is higher than the voltage at the anode thereof, the Organic Light-Emitting Diode (OLED) is still turned off even if the first switch module 22 and the second switch module 23 have been turned on at that time.

However, since in the display phase, the voltage at the first terminal C1 of the storage capacitor Cs is $V_{Data}-|Vth|$, and the first switch module 22 and the second switch module 23 are turned on, a pathway is formed from the first terminal 221 of the first switch module 22 to the input end of the low-level signal VEE, and also the voltage V1 at the second terminal C2 of the storage capacitor Cs is higher than the voltage of the low-level signal VEE, then there is current generated in the pathway.

When the current flows through the pathway, the potential at the second terminal C2 of the storage capacitor Cs decreases constantly, and when the voltage at the second terminal C2 of the storage capacitor Cs decreases to be lower than the voltage of the high-level signal VDD, that is, the potential at the cathode of the Organic Light-Emitting Diode (OLED) is lower than the potential at the anode thereof, the Organic Light-Emitting Diode (OLED) is turned on, and when the current flowing though the Organic Light-Emitting Diode (OLED) is stabilized, there is a fixed voltage difference $V_{OLED}$ between the anode and the cathode thereof, that is, the voltage difference between the anode and the second terminal C2 of the storage capacitor Cs. The value of the fixed voltage difference $V_{OLED}$ is determined by the device size, the resistance, etc., of the Organic Light-Emitting Diode (OLED).

At this time, the voltage $V_{c2}$ at the second terminal C2 of the storage capacitor Cs is $VDD-V_{OLED}$, that is, compared with the beginning, the voltage at the second terminal C2 of the storage capacitor Cs is decreased by ΔV:

$$\Delta V=V1-(VDD-V_{OLED}).$$

Since the first terminal C1 of the storage capacitor Cs still floats, the voltage at the first terminal C1 of the storage capacitor Cs may also decrease by ΔV, then at this time the voltage at the first terminal C1 of the storage capacitor Cs is:

$$V_{C1}=V_{Data}-|Vth|-\Delta V=V_{Data}-|Vth|-V1+VDD-V_{OLED}.$$

Thus at this time the gate-source voltage difference Vgs of the drive transistor Td is:

$$\begin{aligned} Vgs &= V_{C2}-V_{C1} \\ &= (VDD-V_{OLED})-(V_{Data}-|Vth|-V1+VDD-V_{OLED}) \\ &= V1-V_{Data}+|Vth|. \end{aligned}$$

The value of the stabilized current $I_{OLED}$ flowing through the Organic Light-Emitting Diode (OLED) may be calculated according to the formula reflecting a current characteristic of a transistor operating in a saturation area as:

$$I_{OLED}=K(Vgs-|Vth|)^2.$$

Where K is a structural parameter, and Vth is the threshold voltage of the transistor, and the values of K and Vth are ascertained values for a certain transistor; and Vgs is the gate-source voltage difference of the drive transistor Td, and Vgs is equal to $V1-V_{Data}+|Vth|$ for the OLED pixel circuit according to the second embodiment of the invention, and then the current $I_{OLED}$ flowing through the Organic Light-Emitting Diode (OLED) is: $I_{OLED}=K(V1-V_{Data})^2$.

As can be apparent, the current $I_{OLED}$ driving the Organic Light-Emitting Diode (OLED) to emit light is independent of both the high-level signal VDD and the threshold voltage Vth of the drive transistor Td in the pixel circuit according to the second embodiment, that is, the pixel circuit according to the second embodiment can eliminate an influence of the high-level signal VDD and the threshold voltage Vth on the current $I_{OLED}$ driving the Organic Light-Emitting Diode (OLED) to emit light and further improve the display uniformity.

Furthermore, a reset phase is further included before the data signal loading phase in the OLED pixel circuit according to the second embodiment of the invention, as illustrated in FIG. 5.

In the reset phase, the first switch module 22 is turned off, and the second switch module 23 is turned on, and the signal loading module 21 transmits the first voltage signal V1 to the second terminal C2 of the storage capacitor Cs through a sixth terminal 216 of the signal loading module 21, and transmits a signal received by the seventh terminal 217 of the signal loading module 21 to the first terminal C1 of the storage capacitor Cs through the eighth terminal 218 of the signal loading module 21.

In the OLED pixel circuit illustrated in FIG. 5, in the reset phase, since the second switch module 23 is turned on, the low-level signal VEE may be transmitted to the seventh terminal 217 of the signal loading module 21 through the second switch module 23, and since in the reset phase, the signal loading module 21 transmits the signal received by the seventh terminal 217 of the signal loading module 21 to the first terminal C1 of the storage capacitor Cs through the eighth terminal 218 of the signal loading module 21, the voltage at the first terminal C1 of the storage capacitor Cs is VEE at the end of the reset phase.

In other words, before the data signal loading phase, i.e., before the data signal Data of the current image frame is transmitted to the first terminal C1 of the storage capacitor Cs, the OLED pixel circuit may reset the voltages at the two terminals of the storage capacitor Cs, to avoid an influence of a data signal of a previous image frame, displayed by the pixel circuit, remaining on the storage capacitor Cs on the display of the data signal of the current image frame.

In the display phase, the first switch module 22 is turned on, and the drive transistor Td may be turned on under the control of the voltage at the gate thereof, so the value of the voltage at the gate needs to be maintained stably at the gate, and in order to have the values of V1 and $V_{Data}$−|Vth| stored stably at the two terminals of the storage capacitor Cs so as to ensure an accurate display in the display phase without any deviation in voltage value, preferably, a data signal maintaining phase is further included between the data signal loading phase and the display phase in the OLED pixel circuit according to the second embodiment of the invention.

In the data signal maintaining phase, the signal loading module 21 does not transmit the data signal Data of the current image frame to the first terminal C1 of the storage capacitor Cs any longer, and does not transmit the first voltage signal V1 to the second terminal C2 of the storage capacitor Cs any longer; and the first switch module 22 is turned off, and the second switch module 23 is turned on, so the values of V1 and $V_{Data}$−|Vth| are maintained stably at the two terminals of the storage capacitor Cs, and the Organic Light-Emitting Diode (OLED) pixel circuits at the same row in the display panel can start to display at the same time, to improve the uniformity of a display effect.

Figure 6:
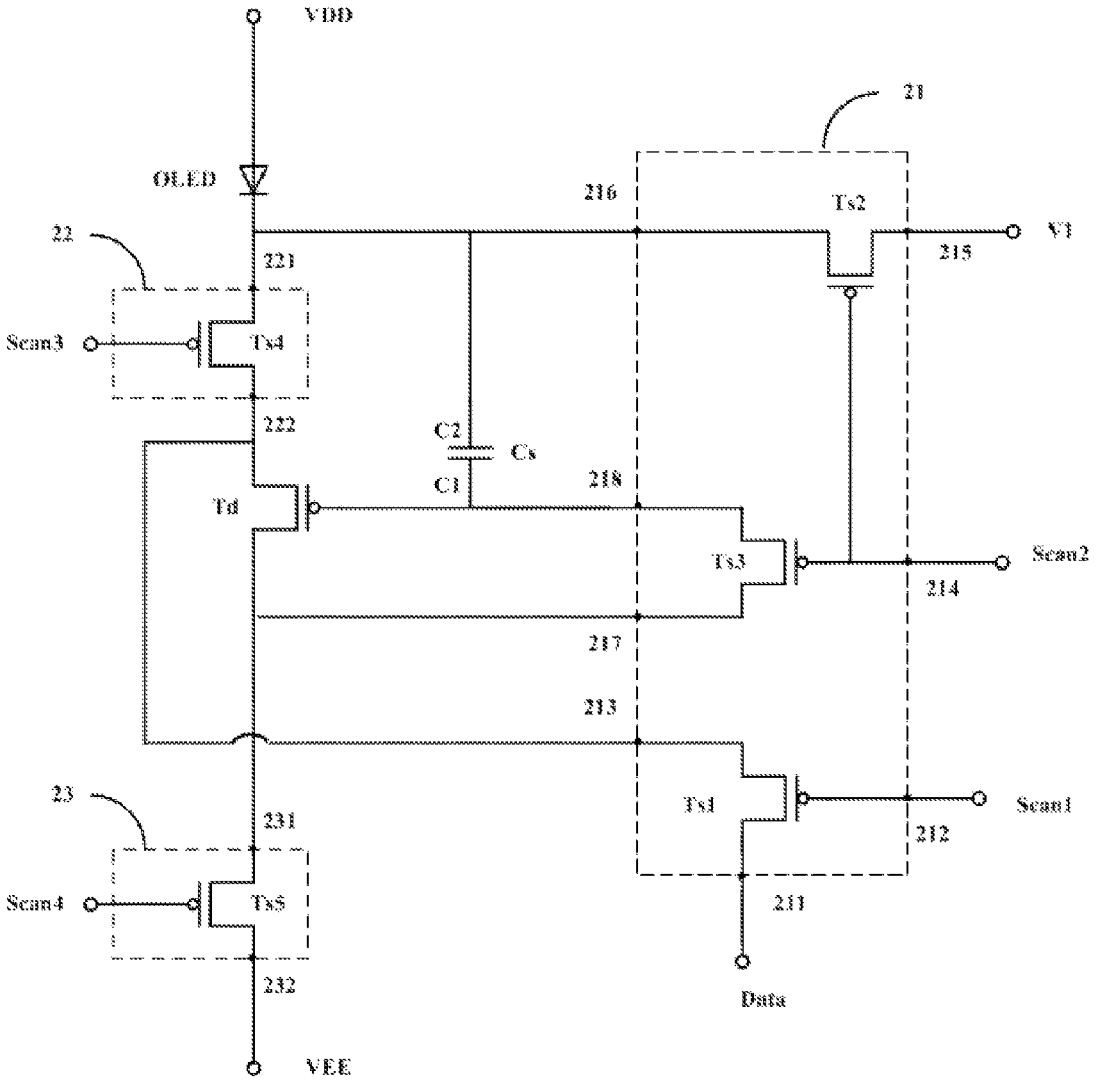
FIG. 6 is a schematic diagram of an OLED pixel circuit according to a third embodiment of the invention.

Referring to FIG. 6, a third embodiment of the invention provides an OLED pixel circuit, as illustrated in FIG. 6, which includes a signal loading module 21, an Organic Light-Emitting Diode (OLED), a drive transistor Td, a storage capacitor Cs, a first switch module 22 and a second switch module 23.

The signal loading module 21 has a first terminal 211 receiving a data signal Data of a current image frame, a second terminal 212 receiving a first scan signal Scan1, a third terminal 213 connected respectively with a gate of the drive transistor Td and a first terminal C1 of the storage capacitor Cs through a source of the drive transistor Td, a fourth terminal 214 receiving a second scan signal Scan2, a fifth terminal 215 receiving a first voltage signal V1, a sixth terminal 216 connected respectively with a second terminal C2 of the storage capacitor Cs, a cathode of the Organic Light-Emitting Diode (OLED) and a first terminal 221 of the first switch module 22, a seventh terminal 217 connected with a drain of the drive transistor Td, and an eighth terminal 218 connected with the gate of the drive transistor Td.

The OLED has an anode receiving a high-level signal VDD and a cathode connected with the first terminal 221 of the first switch module 22, a second terminal 222 of the first switch module 22 is connected with the source of the drive transistor Td, a first terminal 231 of the second switch module 23 is connected with the drain of the drive transistor Td, and a second terminal 232 of the second switch module 23 receives a low-level signal VEE. The voltage of the high-level signal VDD is lower than the voltage of the first voltage signal V1.

Specifically, the signal loading module 21 includes a first thin film transistor Ts1, a second thin film transistor Ts2 and a third thin film transistor Ts3. The thin film transistor Ts1 has a source which is the first terminal 211 of the signal loading module 21 to receive the data signal Data of the current image frame; a gate which is the second terminal 212 of the signal loading module 21 to receive the first scan signal Scan1; and a drain which is the third terminal 213 of the signal loading module 21 to be connected respectively with the gate of the drive transistor Td and the first terminal C1 of the storage capacitor Cs. The thin film transistor Ts2 has a gate which is the fourth terminal 214 of the signal loading module 21 to receive the second scan signal Scan2; a source which is the fifth terminal 215 of the signal loading module 21 to receive the first voltage signal V1; and a drain which is the sixth terminal 216 of the signal loading module 21 to be connected respectively with the second terminal C2 of the storage capacitor Cs, the cathode of the Organic Light-Emitting Diode (OLED) and the first terminal 221 of the first switch module 22. The thin film transistor Ts3 has a gate which is, together with the gate of the thin film transistor Ts2, the fourth terminal 214 of the signal loading module 21 to receive the second scan signal Scan2; a source which is the seventh terminal 217 of the signal loading module 21 to be connected with the drain of the drive transistor Td; and a drain which is the eighth terminal 218 of the signal loading module 21 to be connected with the gate of the drive transistor Td.

The first switch module 22 is a fourth thin film transistor Ts4 with a source which is the first terminal 221 of the first switch module 22 to be connected with the cathode of the Organic Light-Emitting Diode (OLED); a drain which is the second terminal 222 of the first switch module 22 to be connected with the source of the drive transistor Td; and a gate receiving a third scan signal Scan3 to control the first switch module 22, i.e., the fourth thin film transistor Ts4, to be turned on and off.

The first switch module 22 is a fourth thin film transistor Ts4 with a source which is the first terminal 221 of the first switch module 22 to be connected with the cathode of the Organic Light-Emitting Diode (OLED); a drain which is the second terminal 222 of the first switch module 22 to be connected with the source of the drive transistor Td; and a gate receiving a third scan signal Scan3 to control the first switch module 22, i.e., the fourth thin film transistor Ts4, to be turned on and off.

Figure 7E:
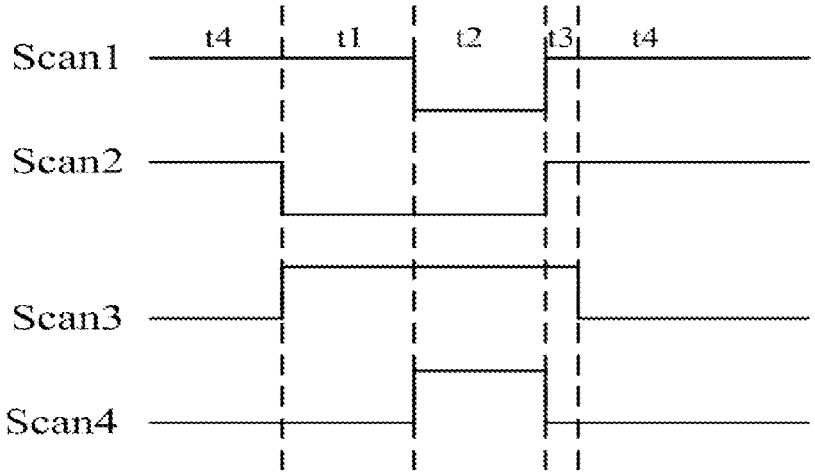
FIG. 7*e* is a timing diagram of driving the OLED pixel circuit illustrated in FIG. 6.

The pixel circuit according to the third embodiment of the invention is driven in fourth phases which are a reset phase t1, a data signal loading phase t2, a data signal maintaining phase t3 and a display phase t4. Reference is made to FIG. 7*e*, which is a timing diagram of driving the pixel circuit illustrated in FIG. 6.

Figure 7A:
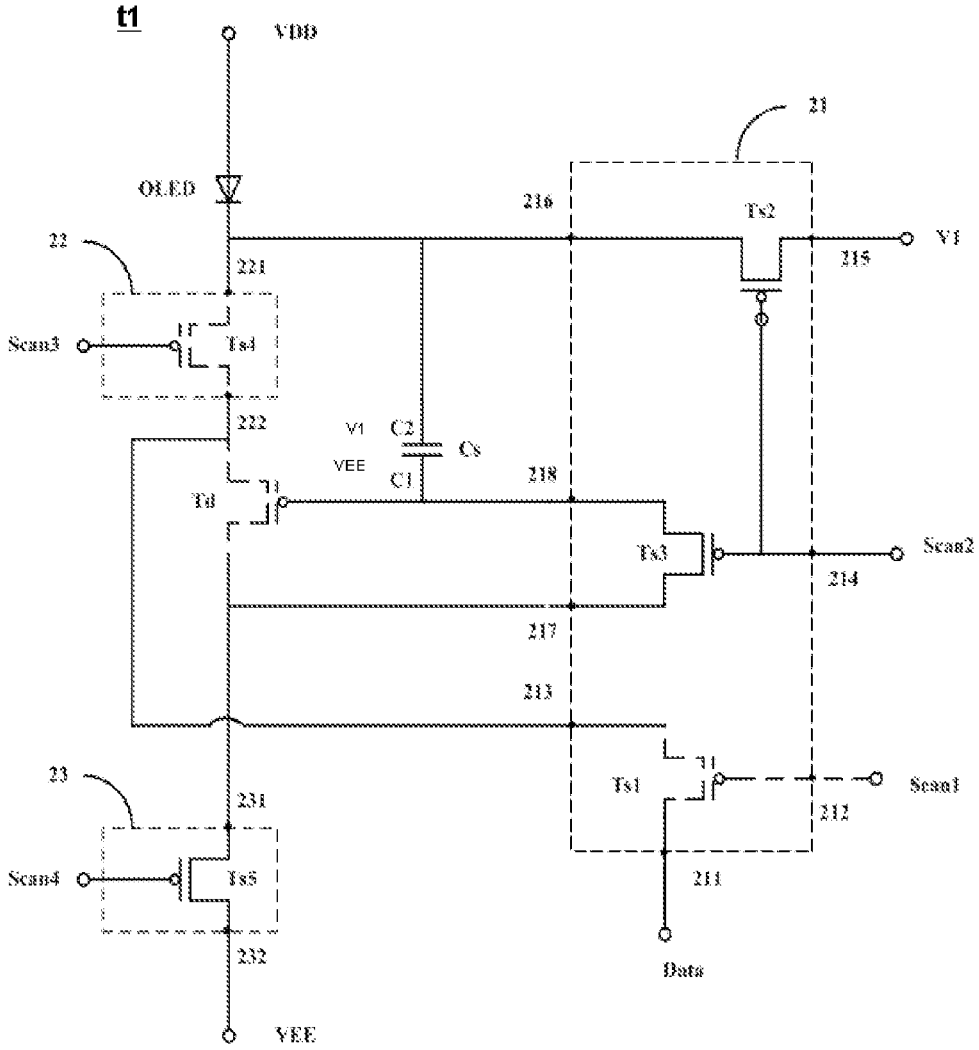
FIG. 7*a* is a schematic diagram of the OLED pixel circuit according to the third embodiment of the invention operating in a reset phase.

FIG. 7*a* is a schematic diagram of the pixel circuit according to the third embodiment operating in the reset phase t1. Referring to FIG. 7*e* and FIG. 7*a*, in the reset phase t1, the first scan signal Scan1 is at a high level, and the first thin film transistor Ts1 is turned off; the second scan signal Scan2 is at a low level, and the second thin film transistor Ts2 and the third thin film transistor Ts3 are turned on; the third scan signal Scan3 is at a high level, and the fourth thin film transistor Ts4 is turned off; and the fourth scan signal Scan4 is at a low level, and the fifth thin film transistor Ts5 is turned on.

The second thin film transistor Ts2 transmits the first voltage signal V1 to the second terminal C2 of the storage capacitor Cs, and the fifth thin film transistor Ts5 and the third thin film transistor Ts3 transmit the low-level signal VEE to the first terminal C1 of the storage capacitor Cs, and the signal at the drain of the drive transistor Td is also the low-level signal VEE, thereby eliminating a signal remaining on the drain of the drive transistor Td when displaying a data signal of a previous image frame and avoiding an influence of the data signal of the previous image frame on the display of the current image frame.

Figure 7B:
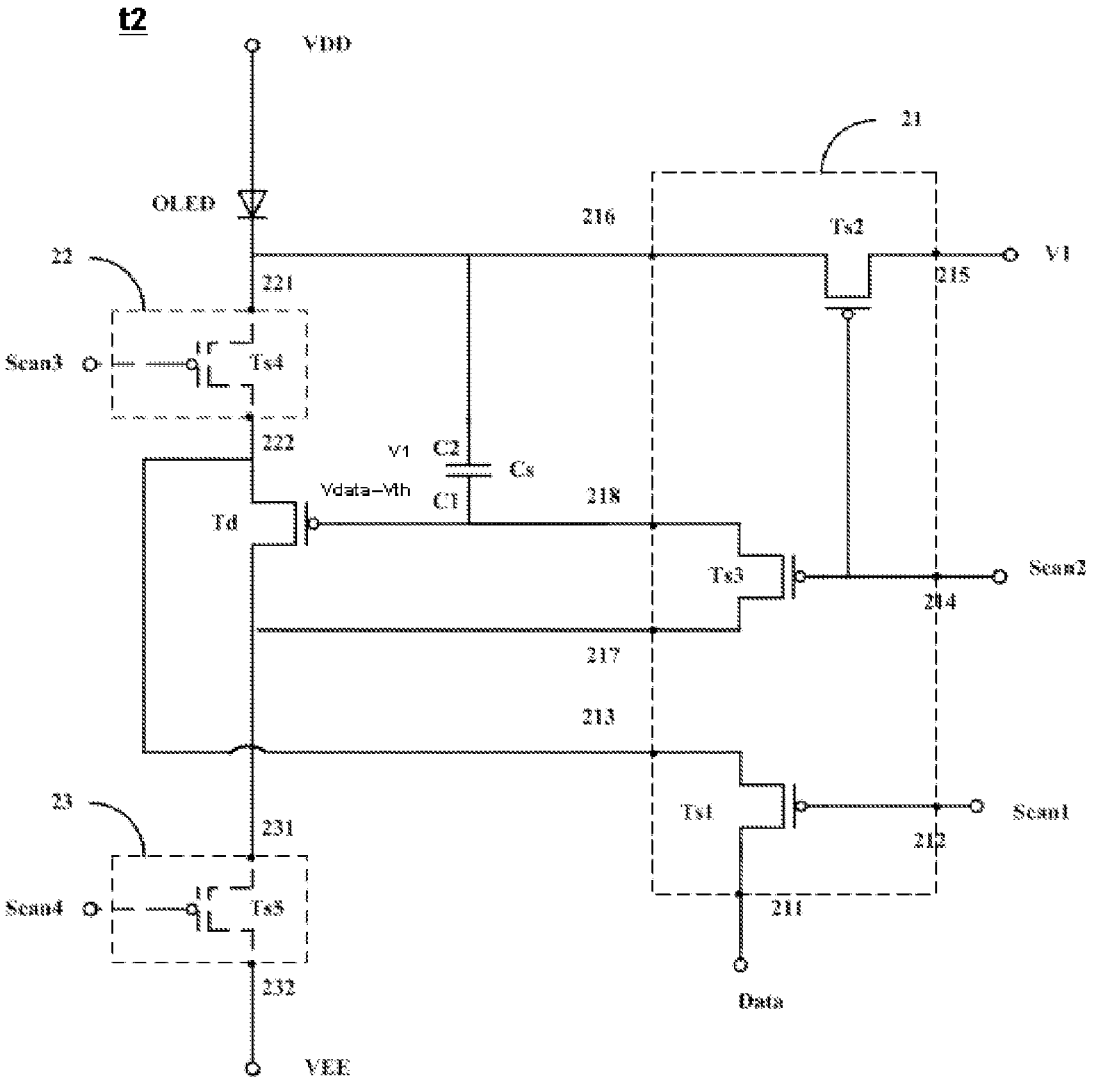
FIG. 7*b* is a schematic diagram of the OLED pixel circuit according to the third embodiment of the invention operating in a data signal loading phase.

Next reference is made to FIG. 7*b*, which is a schematic diagram of the pixel circuit according to the third embodiment operating in the data signal loading phase t2. In the data signal loading phase t2, the first scan signal Scan1 is at a low level, and the first thin film transistor Ts1 is turned on; the second scan signal Scan2 is at a low level, and the second thin film transistor Ts2 and the third thin film transistor Ts3 are turned on; the third scan signal Scan3 is at a high level, and the fourth thin film transistor Ts4 is turned off; and the fourth scan signal Scan4 is at a high level, and the fifth thin film transistor Ts5 is turned off.

The first voltage signal V1 is transmitted to the second terminal C2 of the storage capacitor Cs through the second thin film transistor Ts2. As can be apparent from FIG. 7*b*, the gate of the drive transistor Td is connected with the source of the third thin film transistor Ts3, and the drain of the drive transistor Td is connected with the drain of the third thin film transistor Ts3; and in the data signal loading phase t2, the third thin film transistor Ts3 is controlled by the second scan signal Scan2 to be turned on, that is, the gate and the drain of the drive transistor Td are connected together through the third thin film transistor Ts3.

In the data signal loading phase t2, the data signal Data of the current image frame is transmitted to the source of the drive transistor Td through the first thin film transistor Ts1, and the data signal Data of the current image frame is transmitted gradually to the gate of the drive transistor Td through the drive transistor Td and the third thin film transistor Ts3, and the drive transistor Td is turned off when the voltage difference between the gate of the drive transistor Td and the source thereof is the threshold Vth. In other words, at the end of the data signal loading phase t2, the voltage at the gate of the drive transistor Td is $V_{Data}-|Vth|$, which is also the voltage at the first terminal C1 of the storage capacitor Cs, thus the data signal Data of the current image frame is loaded in the data signal loading phase t2.

Figure 7C:
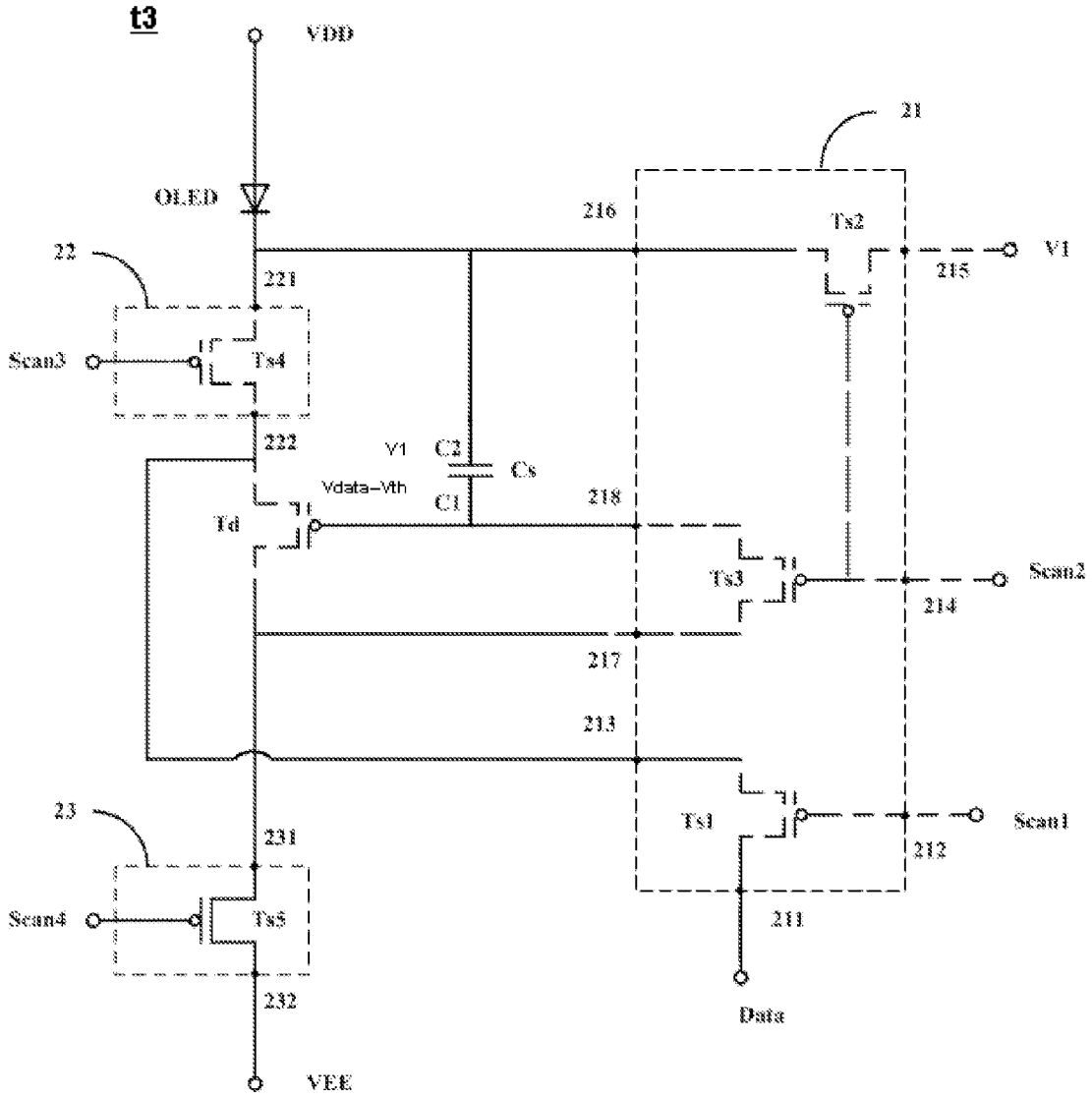
FIG. 7*c* is a schematic diagram of the OLED pixel circuit according to the third embodiment of the invention operating in a data signal maintaining phase.

Next reference is made to FIG. 7*c*, which is a schematic diagram of the pixel circuit according to the third embodiment operating in the data signal maintaining phase t3. In the data signal maintaining phase t3, the first scan signal Scan1 is at a high level, and the first thin film transistor Ts1 is turned off; the second scan signal Scan2 is at a high level, and the second thin film transistor Ts2 and the third thin film transistor Ts3 are turned off; the third scan signal Scan3 is at a high level, and the fourth thin film transistor Ts4 is turned off; and the fourth scan signal Scan4 is at a low level, and the fifth thin film transistor Ts5 is turned on.

Referring to FIG. 7*e*, in the display phase t4, the third scan signal Scan3 is at a low level controlling the fourth thin film transistor Ts4 to be turned on, and the drive transistor Td may be turned on under the control of the voltage at the gate thereof, so the value of the voltage at the gate needs to be maintained stably at the gate; and in the data signal maintaining phase t3, the second scan signal Scan2 is set at a high level, so that the third thin film transistor Ts3 is controlled by the second scan signal Scan2 to be turned off, to have the values of the voltages at the two terminals of the storage capacitor Cs maintained stably at the two terminals of the storage capacitor Cs, that is, the values of the voltages V1 and $V_{Data}-|Vth|$, so as to ensure an accurate display in the display phase t4 without any deviation in voltage value.

Figure 7D:
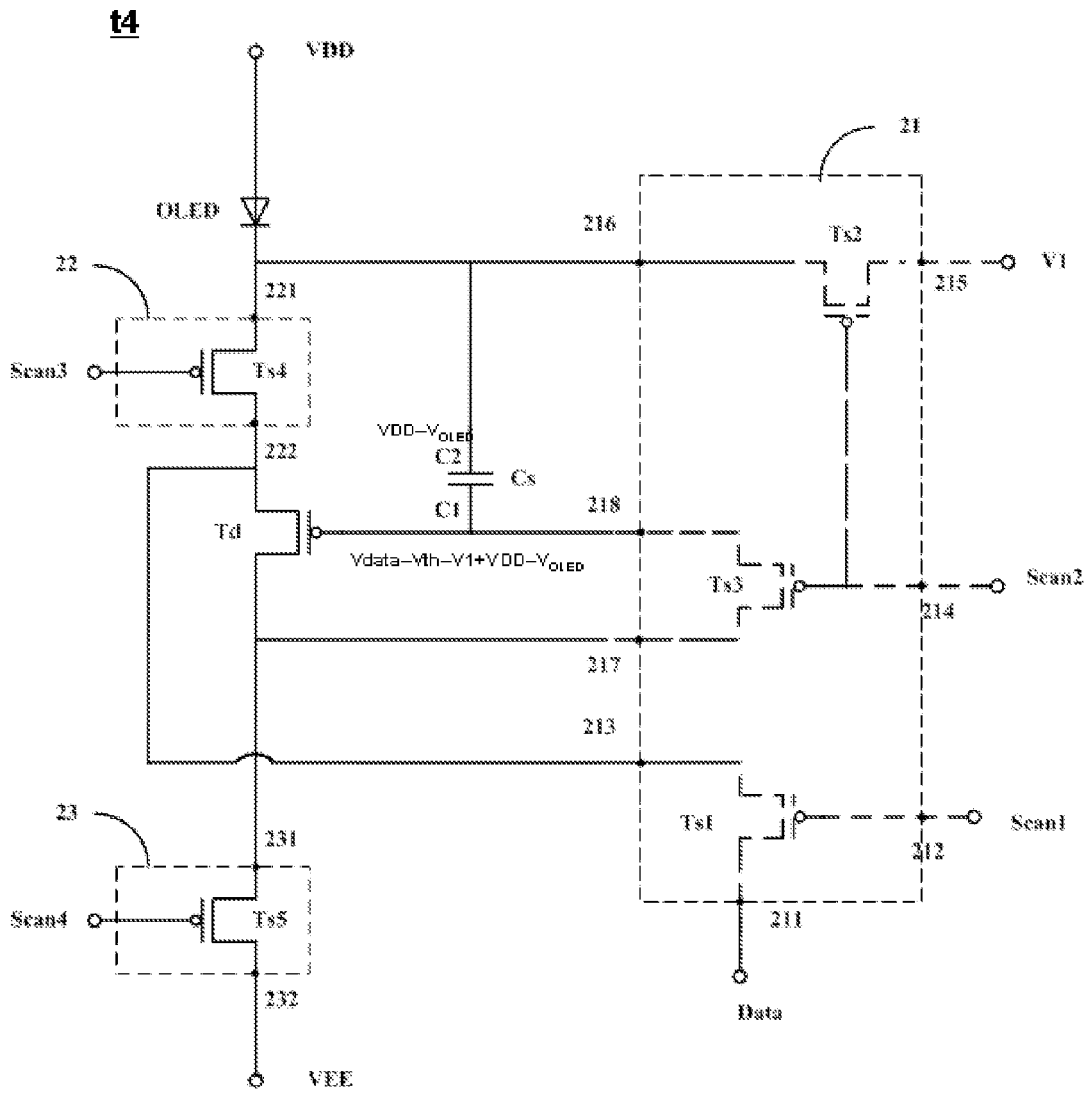
FIG. 7*d* is a schematic diagram of the OLED pixel circuit according to the third embodiment of the invention operating in a display phase.

Reference is made to FIG. 7*d*, which is a schematic diagram of the pixel circuit according to the third embodiment operating in the display phase t4. In the display phase t4, the first scan signal Scan1 is at a high level, and the first thin film transistor Ts1 is turned off; the second scan signal Scan2 is at a high level, and the second thin film transistor Ts2 and the third thin film transistor Ts3 are turned off; the third scan signal Scan3 is at a low level, and the fourth thin film transistor Ts4 is turned on; and the fourth scan signal Scan4 is at a low level, and the fifth thin film transistor Ts5 is turned on.

At the beginning of the display phase t4, the voltage at the second terminal C2 of the storage capacitor Cs is still V1, and since the voltage of the first voltage signal V1 is higher than the voltage of the high-level signal VDD, that is, the voltage at the cathode of the Organic Light-Emitting Diode (OLED) is higher than the voltage at the anode thereof, the Organic Light-Emitting Diode (OLED) may still be turned off even if the fourth thin film transistor Ts4 and the fifth thin film transistor Ts5 have been turned on at that time.

However, since in the display phase, the voltage at the first terminal C1 of the storage capacitor Cs is $V_{Data}-|Vth|$, and also since the fourth thin film transistor Ts4 and the fifth thin film transistor Ts5 are turned on, a pathway is formed from the first terminal 221 of the fourth thin film transistor Ts4 to the input terminal of the low-level signal VEE, and since the voltage V1 at the second terminal C2 of the storage capacitor Cs is higher than the voltage of the low-level signal VEE, there is current generated in the pathway.

When the current flows through the pathway, the potential at the second terminal C2 of the storage capacitor Cs decreases constantly, and when the voltage at the second terminal C2 of the storage capacitor Cs decreases to be lower than the voltage of the high-level signal VDD, that is, the potential at the cathode of the Organic Light-Emitting Diode (OLED) is lower than the potential at the anode thereof, the Organic Light-Emitting Diode (OLED) is turned on, and when the current flowing through the Organic Light-Emitting Diode (OLED) is stabilized, there is a fixed voltage difference $V_{OLED}$ between the anode and the cathode thereof, that is, the voltage difference between the anode and the second terminal C2 of the storage capacitor Cs. The value of the fixed voltage difference $V_{OLED}$ is determined by the device size, the resistance, etc., of the Organic Light-Emitting Diode (OLED).

At this time, the voltage $V_{c2}$ at the second terminal C2 of the storage capacitor Cs is $VDD-V_{OLED}$, that is, compared with the beginning, the voltage at the second terminal C2 of the storage capacitor Cs is decreased by ΔV:

$$\Delta V=V1-(VDD-V_{OLED}).$$

Since the first terminal C1 of the storage capacitor Cs still floats, the voltage at the first terminal C1 of the storage capacitor Cs may also decrease by ΔV, and then at this time the voltage at the first terminal C1 of the storage capacitor Cs is:

$$V_{C1}=V_{Data}-|Vth|-\Delta V=V_{Data}-|Vth|-V1+VDD-V_{OLED}.$$

Thus at this time, the gate-source voltage difference Vgs of the drive transistor Td is:

$$\begin{aligned} Vgs &= V_{C2}-V_{C1} \\ &= (VDD-V_{OLED})-(V_{Data}-|Vth|-V1+VDD-V_{OLED}) \\ &= V1-V_{Data}+|Vth|. \end{aligned}$$

The value of the stabilized current $I_{OLED}$ flowing through the Organic Light-Emitting Diode (OLED) may be calculated according to the formula reflecting a current characteristic of a transistor operating in a saturation area as:

$$I_{OLED}=K(Vgs-|Vth|)^2.$$

Where K is a structural parameter, and Vth is the threshold voltage of the transistor, and the values of K and Vth are ascertained values for a certain transistor; and Vgs is the gate-source voltage difference of the drive transistor Td, and Vgs is equal to $V1-V_{Data}+|Vth|$ for the OLED pixel circuit according to the third embodiment of the invention, and then the current $I_{OLED}$ flowing through the Organic Light-Emitting Diode (OLED) is: $I_{OLED}=K(V1-V_{Data})^2$.

As can be apparent, the current $I_{OLED}$ driving the Organic Light-Emitting Diode (OLED) to emit light is independent of both the high-level signal VDD and the threshold voltage Vth of the drive transistor Td in the pixel circuit according to the third embodiment, that is, the pixel circuit according to the third embodiment can eliminate an influence of the high-level signal VDD and the threshold voltage Vth on the current $I_{OLED}$ driving the Organic Light-Emitting Diode (OLED) to emit light and improve the display uniformity.

In the third embodiment, the first thin film transistor Ts1, the second thin film transistor Ts2, the third thin film transistor Ts3, the fourth thin film transistor Ts4, the fifth thin film transistor Ts5, and the drive transistor Td are P-type transistors, and in anther embodiment, these thin film transistors may be N-type transistors, or a part of the thin film transistors may be N-type transistors while the other part of the thin film transistors may be P-type transistors, but the technical effect of an improved display uniformity can be achieved so long as the respective thin film transistors are controlled by the driving timing to be turned on or off in the reset phase t1, the data signal loading phase t2, the data signal maintaining phase t3 and the display phase t4 as described above.

Figure 8:
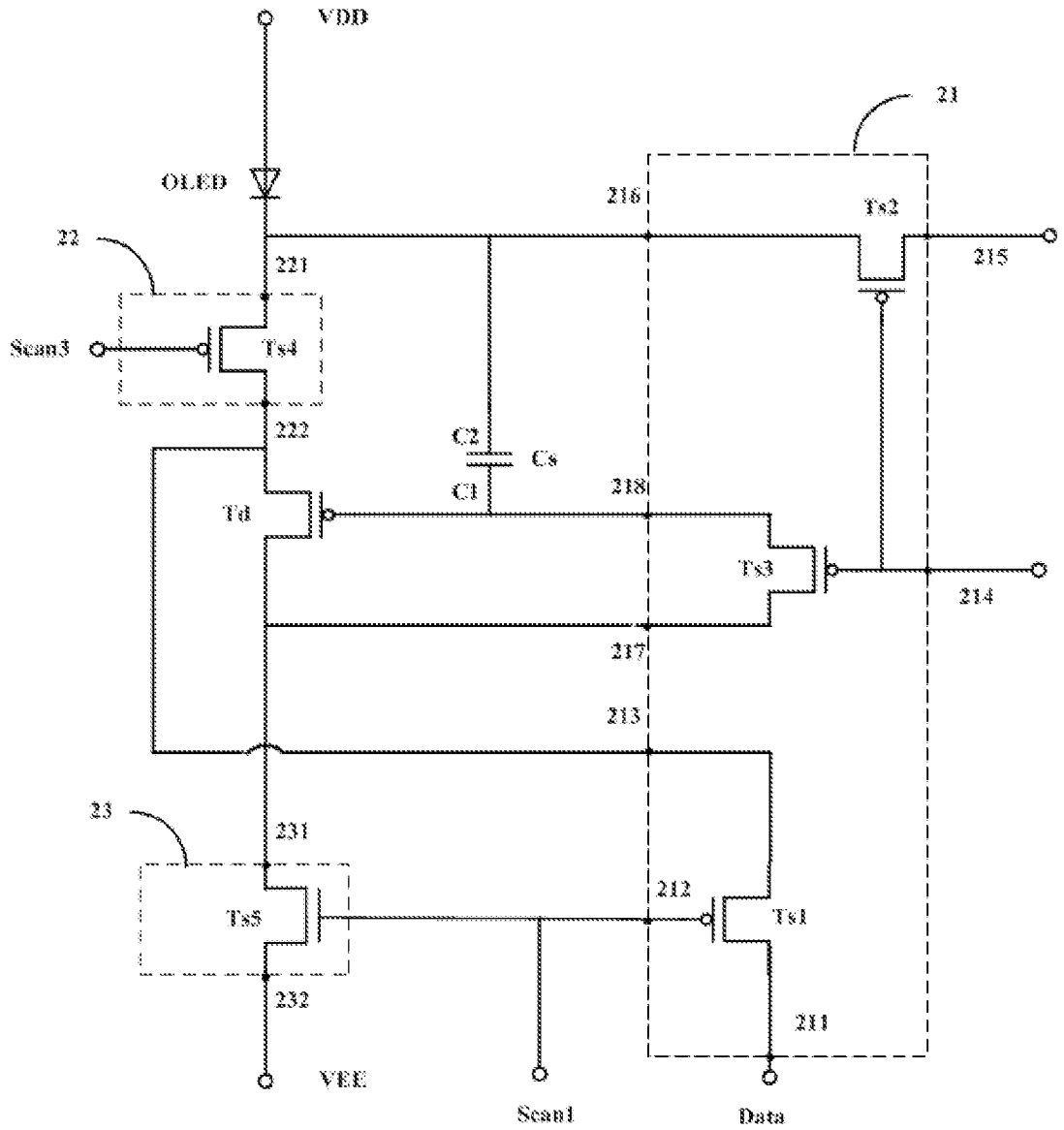
FIG. 8 is a schematic diagram of an OLED pixel circuit according to a fourth embodiment of the invention.
Figure 9:
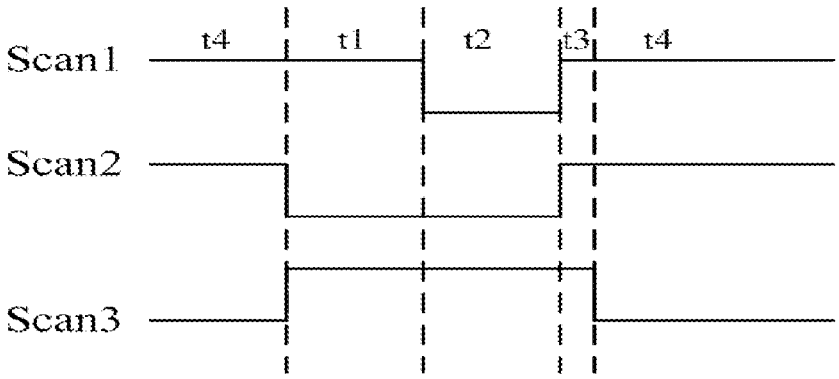
FIG. 9 is a timing diagram of driving the OLED pixel circuit illustrated in FIG. 8.

Referring to FIG. 8 and FIG. 9, FIG. 8 is a pixel circuit according to a fourth embodiment of the invention, and FIG. 9 is a timing diagram of driving the pixel circuit illustrated in FIG. 8. A difference thereof from the third embodiment is that the fifth thin film transistor Ts5 is a P-type transistor, and the fifth thin film transistor Ts5 and the first thin film transistor Ts1 share the first scan signal Scan1.

As can be apparent from FIG. 7*e*, the first scan signal Scan1 is opposite to the fourth scan signal Scan4, that is, the fourth scan signal Scan4 is at a low level when the first scan signal Scan1 is at a high level, and the fourth scan signal Scan4 is at a high level when the first scan signal Scan1 is at a low level. Thus in the fourth embodiment, preferably, the fifth thin film transistor Ts5 is set as a P-type transistor, and the first thin film transistor Ts1 is set as an N-type transistor, so that the fifth thin film transistor Ts5 and the first thin film transistor Ts1 can share the same first scan signal Scan1, to omit one of the input signals in the pixel circuit.

The remaining parts of the fourth embodiment are the same as those in the third embodiment, and the operation of the pixel circuit in the fourth embodiment may be divided into a reset phase t1, a data signal loading phase t2, a data signal maintaining phase t3 and a display phase t4, to eliminate an influence of the high-level signal VDD and the threshold voltage Vth on the current $I_{OLED}$ driving the Organic Light-Emitting Diode (OLED) to emit light, and improve the display uniformity.

Of course, in another embodiment, the fifth thin film transistor Ts5 may be set as an N-type transistor, and the first thin film transistor Ts1 may be set as a P-type transistor, and the fifth thin film transistor Ts5 and the first thin film transistor Ts1 may share the fourth scan signal Scan4, thus also achieving the same technical effect.

An embodiment of the invention provides an OLED display panel including the pixel circuit as described above, to drive a display by the display panel. The OLED display panel according to the embodiment of the invention with a uniform display effect may be applicable to various display terminals, e.g., a handset, a computer display, etc.

With the OLED pixel circuit, the display panel and the display device according to the embodiments of the invention, in the data signal loading phase, the received data signal is transmitted to the first terminal of the storage capacitor, since the voltage of the first voltage signal is higher than the voltage of the high-level signal, the OLED is turned off. The pixel circuit can transmit the first voltage signal to the second terminal of the storage capacitor in the data signal loading phase, and the first switch module and the second switch module are turned on in the display phase, so that the image data signal is not transmitted to the first terminal of the storage capacitor any longer, and thus this terminal floats, and the first voltage signal is not transmitted to the second terminal of the storage capacitor any longer, and thus this terminal also floats. Due to leakage current on the storage capacitor, the voltages at the two terminals of the storage capacitor decrease constantly, and when the voltage at the second terminal of the storage capacitor decreases from the voltage of the first voltage signal until the OLED can be turned on, the voltage at the second terminal of the storage capacitor is changed from the first voltage signal to the high-level signal, and the voltage at the first terminal of the storage capacitor decreases by the same amount as the voltage at the second terminal of the storage capacitor decreases. Thus after the OLED is turned on, the high-level signal may appear in both the voltage at the gate and the voltage at the source of the drive transistor, and at this time the signal stored on the storage capacitor enables the drive transistor to operate in the saturation area to drive the OLED to emit light, where the current at the drain of the drive transistor operating in the saturation area is in proportion to the square of the voltage difference between the gate and the source of the drive transistor, so the high-level signal can be cancelled off and thus has no influence on the current at the drain, to avoid the situation in the existing OLED pixel circuit that there is current flowing all the time over a power line directing a backboard power source VDD to respective rows of pixels and there is also a resistance on the power line so that the voltage on the power line varies at the different rows of pixels, and hence address the problem of varying current driving the different pixels at which the same data signal is received, so as to improve the display uniformity.

Those skilled in the art can appreciate that the drawings are merely schematic diagrams of some preferred embodiments and the modules or the flows in the drawings may not necessarily be required to implement the invention.

Those skilled in the art can appreciate that modules in a device according to an embodiment can be distributed in the device according to the embodiment as described in the embodiment or can be distributed in one or more devices other than this embodiment while being modified accordingly. The modules according to the embodiment can be combined into one module or can be further divided into multiple sub-modules.

The embodiments of the invention have been numerated above merely for the purpose of a description without suggesting any superiority of one embodiment to another.

Evidently those skilled in the art can make various modifications and variations to the invention without departing from the spirit and scope of the invention. Thus the invention is also intended to encompass these modifications and variations thereto so long as the modifications and variations come into the scope of the claims appended to the invention and their equivalents.

What is claimed is:

1. An organic light-emitting diode pixel circuit, comprising:

a signal loading module;

an organic light-emitting diode;

a drive transistor connected to the signal loading module and configured to provide a current to the organic light-emitting diode;

a storage capacitor connected to the drive transistor; and first and second switch modules configured to selectively control current to and from the drive transistor, wherein a first terminal of the signal loading module is connected with a data signal for a current image frame, a second terminal of the signal loading module is connected with a first scan signal, a third terminal of the signal loading module is connected with a gate of the drive transistor and a first terminal of the storage capacitor, a fourth terminal of the signal loading module is connected with a second scan signal, a fifth terminal of the signal loading module is connected with a first voltage signal, and a sixth terminal of the signal loading module is connected with a second terminal of the storage capacitor, a cathode of the organic light-emitting diode, and a first terminal of the first switch module, and wherein an anode of the organic light-emitting diode is configured to receive a high-level signal, a second terminal of the first switch module is connected with a source of the drive transistor, a first terminal of the second switch module is connected with a drain of the drive transistor, and a second terminal of the second switch module is connected with a low-level signal, and wherein the voltage of the first voltage signal is higher than the voltage of the high-level signal.

2. The pixel circuit according to claim 1, wherein the pixel circuit is configured to operate during a data signal loading phase and a display phase, wherein during the data signal loading phase, the signal loading module transmits the data signal of the current image frame to the first terminal of the storage capacitor through the third terminal of the signal loading module, and transmits the first voltage signal to the second terminal of the storage capacitor through the sixth terminal of the signal loading module, and wherein the first switch module and the second switch module are turned off, wherein during the display phase, the signal loading module does not transmit the data signal of the current image frame to the first terminal of the storage capacitor any longer, and does not transmit the first voltage signal to the second terminal of the storage capacitor any longer, wherein the first switch module and the second switch module are turned on, and the drive transistor drives the organic light-emitting diode with the signal stored in the storage capacitor.

3. The pixel circuit according to claim 2, wherein the third terminal of the signal loading module is connected with the gate of the drive transistor and the first terminal of the storage capacitor through the source of the drive transistor, and wherein the signal loading module further comprises a seventh terminal and an eighth terminal, wherein the seventh terminal of the signal loading module is connected with the drain of the drive transistor, and the eighth terminal of the signal loading module is connected with the gate of the drive transistor.

4. The pixel circuit according to claim 3, wherein during the data signal loading phase, the signal loading module further connects the gate of the drive transistor with the drain of the drive transistor, so that the data signal of the current image frame is transmitted to the first terminal of the storage capacitor through the third terminal of the signal loading module, and during the display phase, the signal loading module disconnects the gate of the drive transistor from the drain of the drive transistor.

5. The pixel circuit according to claim 2, wherein the pixel circuit is configured to operate during a data signal maintaining phase between the data signal loading phase and the display phase, wherein during the data signal maintaining phase, the signal loading module does not transmit the data signal of the current image frame to the first terminal of the storage capacitor any longer, and does not transmit the first voltage signal to the second terminal of the storage capacitor any longer, and the first switch module is turned off, and the second switch module is turned on.

6. The pixel circuit according to claim 3, wherein the pixel circuit is configured to operate during a reset phase before the data signal loading phase; and wherein, during the reset phase, the first switch module is turned off, the second switch module is turned on, and the signal loading module transmits the first voltage signal to the second terminal of the storage capacitor through the sixth terminal of the signal loading module, and the signal loading module transmits a signal received by the seventh terminal of the signal loading module to the first terminal of the storage capacitor through the eighth terminal of the signal loading module.

7. The pixel circuit according to claim 3, wherein the signal loading module comprises:

a first thin film transistor;

a second thin film transistor; and a third thin film transistor, wherein the first thin film transistor comprises:

a source connected to the first terminal of the signal loading module, a gate connected to the second terminal of the signal loading module, and a drain connected to the third terminal of the signal loading module, wherein the second thin film transistor comprises:

a gate connected to the fourth terminal of the signal loading module, a source connected to the fifth terminal of the signal loading module, and a drain connected to the sixth terminal of the signal loading module, and wherein the third thin film transistor comprises:

a gate connected to the fourth terminal of the signal loading module, a source connected to the seventh terminal of the signal loading module, and a drain which is the eighth terminal of the signal loading module.

8. The pixel circuit according to claim 3, wherein the first switch module comprises a fourth thin film transistor comprising:

a source connected to the first terminal of the first switch module, a drain which is the second terminal of the first switch module, and a gate connected with a third scan signal.

9. The pixel circuit according to claim 3, wherein the second switch module comprises a fifth thin film transistor comprising:

a source connected to the first terminal of the second switch module, a drain connected to the second terminal of the second switch module, and a gate connected with a fourth scan signal.

10. A display panel, comprising an organic light-emitting diode pixel circuit, wherein the organic light-emitting diode pixel circuit comprises:

a signal loading module;

an organic light-emitting diode;

a drive transistor connected to the signal loading module and configured to provide a current to the organic light-emitting diode;

a storage capacitor connected to the drive transistor; and first and second switch modules configured to selectively control current to and from the drive transistor, wherein a first terminal of the signal loading module is connected with a data signal for a current image frame, a second terminal of the signal loading module is connected with a first scan signal, a third terminal of the signal loading module is connected with a gate of the drive transistor and a first terminal of the storage capacitor, a fourth terminal of the signal loading module is connected with a second scan signal, a fifth terminal of the signal loading module is connected with a first voltage signal, and a sixth terminal of the signal loading module is connected with a second terminal of the storage capacitor, a cathode of the organic light-emitting diode, and a first terminal of the first switch module, and wherein an anode of the organic light-emitting diode is configured to receive a high-level signal, a second terminal of the first switch module is connected with a source of the drive transistor, a first terminal of the second switch module is connected with a drain of the drive transistor, and a second terminal of the second switch module is connected with a low-level signal, and wherein the voltage of the first voltage signal is higher than the voltage of the high-level signal.

11. The display panel according to claim 10, wherein the pixel circuit is configured to operate during a data signal loading phase and a display phase;

in wherein during the data signal loading phase, the signal loading module transmits the data signal of the current image frame to the first terminal of the storage capacitor through the third terminal of the signal loading module, and transmits the first voltage signal to the second terminal of the storage capacitor through the sixth terminal of the signal loading module, and wherein the first switch module and the second switch module are turned off, wherein during the display phase, the signal loading module does not transmit the data signal of the current image frame to the first terminal of the storage capacitor any longer, and does not transmit the first voltage signal to the second terminal of the storage capacitor any longer, wherein the first switch module and the second switch module are turned on, and the drive transistor drives the organic light-emitting diode with the signal stored in the storage capacitor.

12. The display panel according to claim 11, wherein the third terminal of the signal loading module is connected with the gate of the drive transistor and the first terminal of the storage capacitor through the source of the drive transistor, and wherein the signal loading module further comprises a seventh terminal and an eighth terminal, wherein the seventh terminal of the signal loading module is connected with the drain of the drive transistor, and the eighth terminal of the signal loading module is connected with the gate of the drive transistor.

13. The display panel according to claim 12, wherein during the data signal loading phase, the signal loading module further connects the gate of the drive transistor with the drain of the drive transistor, so that the data signal of the current image frame is transmitted to the first terminal of the storage capacitor through the third terminal of the signal loading module, and during the display phase, the signal loading module disconnects the gate of the drive transistor from the drain of the drive transistor.

14. The display panel according to claim 11, wherein the pixel circuit is configured to operate during a data signal maintaining phase between the data signal loading phase and the display phase, wherein during the data signal maintaining phase, the signal loading module does not transmit the data signal of the current image frame to the first terminal of the storage capacitor any longer, and does not transmit the first voltage signal to the second terminal of the storage capacitor any longer, and the first switch module is turned off, and the second switch module is turned on.

15. The display panel according to claim 12, wherein the pixel circuit is configured to operate during a reset phase before the data signal loading phase; and wherein, during the reset phase, the first switch module is turned off, the second switch module is turned on, and the signal loading module transmits the first voltage signal to the second terminal of the storage capacitor through the sixth terminal of the signal loading module, and the signal loading module transmits a signal received by the seventh terminal of the signal loading module to the first terminal of the storage capacitor through the eighth terminal of the signal loading module.

16. The display panel according to claim 12, wherein the signal loading module comprises:

a first thin film transistor;

a second thin film transistor; and a third thin film transistor, wherein the first thin film transistor comprises:

a source connected to the first terminal of the signal loading module, a gate connected to the second terminal of the signal loading module, and a drain connected to the third terminal of the signal loading module, wherein the second thin film transistor comprises:

a gate connected to the fourth terminal of the signal loading module, a source connected to the fifth terminal of the signal loading module, and a drain connected to the sixth terminal of the signal loading module, and wherein the third thin film transistor comprises:

a gate connected to the fourth terminal of the signal loading module, a source connected to the seventh terminal of the signal loading module, and a drain which is the eighth terminal of the signal loading module.

17. The display panel according to claim 12, wherein the first switch module comprises a fourth thin film transistor comprising:

a source connected to the first terminal of the first switch module, a drain which is the second terminal of the first switch module, and a gate connected with a third scan signal.

18. The display panel according to claim 12, wherein the second switch module comprises a fifth thin film transistor comprising:

a source connected to the first terminal of the second switch module, a drain connected to the second terminal of the second switch module, and a gate connected with a fourth scan signal.

19. A display device, comprising a display panel, comprising an organic light-emitting diode pixel circuit, wherein the organic light-emitting diode pixel circuit comprises:

a signal loading module;

an organic light-emitting diode;

a drive transistor connected to the signal loading module and configured to provide a current to the organic light-emitting diode;

a storage capacitor connected to the drive transistor; and first and second switch modules configured to selectively control current to and from the drive transistor, wherein a first terminal of the signal loading module is connected with a data signal for a current image frame, a second terminal of the signal loading module is connected with a first scan signal, a third terminal of the signal loading module is connected with a gate of the drive transistor and a first terminal of the storage capacitor, a fourth terminal of the signal loading module is connected with a second scan signal, a fifth terminal of the signal loading module is connected with a first voltage signal, and a sixth terminal of the signal loading module is connected with a second terminal of the storage capacitor, a cathode of the organic light-emitting diode, and a first terminal of the first switch module, and wherein an anode of the organic light-emitting diode is configured to receive a high-level signal, a second terminal of the first switch module is connected with a source of the drive transistor, a first terminal of the second switch module is connected with a drain of the drive transistor, and a second terminal of the second switch module is connected with a low-level signal, and wherein the voltage of the first voltage signal is higher than the voltage of the high-level signal.

* * * * *